United States Patent [19]

Karadimas

[11] Patent Number: 4,705,452

[45] Date of Patent: Nov. 10, 1987

[54] STATOR VANE HAVING A MOVABLE TRAILING EDGE FLAP

[75] Inventor: Georges Karadimas, Vanves, France

[73] Assignee: Societe Nationale d'Etude et de Construction de Moteurs d'Aviation (SNECMA), France

[21] Appl. No.: 896,239

[22] Filed: Aug. 14, 1986

[30] Foreign Application Priority Data

Aug. 14, 1985 [FR] France ..... 85 12366

[51] Int. Cl.[4] ..... F01D 9/02; F04D 29/56

[52] U.S. Cl. ..... 415/115; 415/161

[58] Field of Search ..... 415/115, 116, 161, 160, 415/162, 163, 159, 164; 416/96 A, 97 R

[56] References Cited

U.S. PATENT DOCUMENTS

| | | | |
|---|---|---|---|
| 2,856,758 | 10/1958 | Eggleston et al. | 415/160 |
| 2,866,313 | 12/1958 | Holl | 415/161 X |
| 3,442,493 | 5/1969 | Smith, Jr. | 415/161 X |
| 3,563,669 | 2/1971 | Hockert et al. | 415/161 |
| 3,992,128 | 11/1976 | Lunsford et al. | 415/161 |
| 4,053,256 | 10/1977 | Hertel | 415/160 X |
| 4,193,738 | 3/1980 | Landis, Jr. et al. | 415/115 |
| 4,297,077 | 10/1981 | Durgin et al. | 415/115 X |
| 4,378,960 | 5/1983 | Lenz | 415/115 |

FOREIGN PATENT DOCUMENTS

| | | | |
|---|---|---|---|
| 159512 | 10/1954 | Australia | 415/161 |
| 659211 | 4/1938 | Fed. Rep. of Germany | 415/115 |
| 1601613 | 12/1970 | Fed. Rep. of Germany | 415/115 |
| 2416724 | 4/1973 | Fed. Rep. of Germany . | |
| 942182 | 9/1983 | France . | |
| 733286 | 3/1943 | Netherlands . | |
| 774501 | 5/1957 | United Kingdom . | |
| 805015 | 11/1958 | United Kingdom | 415/161 |

*Primary Examiner*—Robert E. Garrett
*Assistant Examiner*—Joseph M. Pitko
*Attorney, Agent, or Firm*—Bacon and Thomas

[57] ABSTRACT

A stator vane structure is disclosed in which a movable flap is pivotally attached to the stator vane. The flap extends from an intermediate portion of the vane to the trailing edge and may be actuated by a lever and cam mechanism.

8 Claims, 5 Drawing Figures

STATOR VANE HAVING A MOVABLE TRAILING EDGE FLAP

BACKGROUND OF THE INVENTION

A gas turbine, such as an aircraft turbojet engine, typically has an annular array of stator vanes located immediately upstream of a rotor wheel so as to direct the gases onto the rotor blades affixed to the wheel. Such vanes usually have airfoil cross-section with a concave surface and a convex surface interconnected by leading edge and a trailing edge portions. In order to obtain the maximum efficiency from the turbine gases throughout the wide variation in engine operating parameters, it is necessary to vary the gas flow passing over the stator vanes.

It is known to vary the cross-sectional area of the gas flow path between adjacent cooled stator vanes at the narrowest point (designated as the throat neck) by aerodynamic means. However, although these means are generally achievable at relatively low cost, they lead to appreciable reductions in the performance and interfere with the cooling of the vanes.

It is also known to vary the gas flow by mechanical means. This may involve varying the pitch of the entire stator vane or a portion of the vane. The pitch variation, however, creates problems regarding leakage of the gas flow as well as regarding the means referred to achieve adequate sealing.

It is also known to control the gas flow area by incorporating a series of flaps between adjacent stator vanes, which flaps may be extended so as to reduce the height of the gas flow channel. These flaps, when in their extended positions, create large areas of turbulent gas flow which precludes the achievement of optimum operating efficiency.

SUMMARY OF THE INVENTION

It is an object of the present invention to provide for the variation of the gas flow cross-section of a turbine stator vane without incurring the disadvantages of the aforementioned systems. Each of the stator vanes has a movable flap attached, thereto which extends, on the concave side of the airfoil, from an intermediate portion to the trailing edge of the vane. The flap pivots about a radially extending axis which extends substantially perpendicular to the chord of the vane.

A first cooling chamber may be defined between the concave and convex surfaces of the vane which extends from the leading edge portion to an intermediate portion. The movable flap defines, along with a trailing edge portion of the concave surface, a second cooling chamber which may communicate with the first cooling chamber via passages extending through the intermediate portion. Cooling ribs extend inwardly into the second cooling chamber from inner surfaces of the movable flap and the trailing edge portion of the concave surface.

The stator vane according to the invention makes it possible to vary the gas flow cross-section with a minimum of aerodynamic losses as the flap is moved between a retracted, nominal position and an extended position which reduces the gas flow cross-section.

Further characteristics and advantages of the invention will become apparent from the following description taken in reference to the attached drawings.

DETAILED DESCRIPTION OF THE PREFERRED EMBODIMENT

Figure 1:
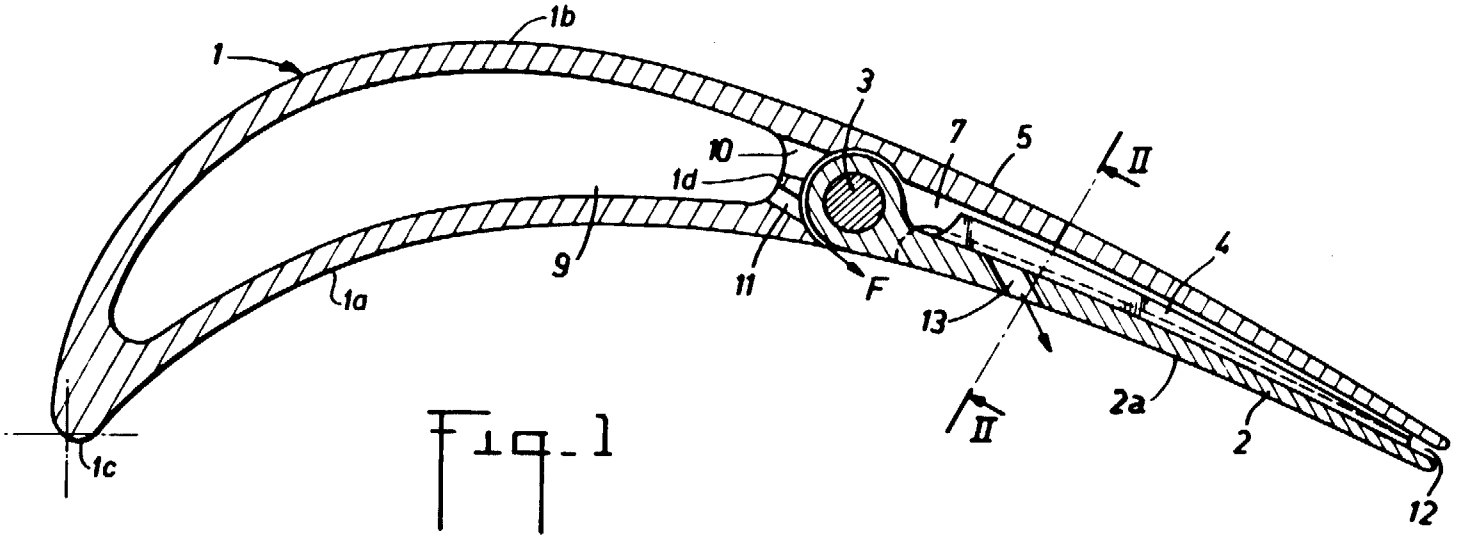
FIG. 1 is a cross-sectional view of the stator vane according to the invention, taken along line I—I in FIG. 2.

FIG. 1 shows a cross-sectional view of a stator vane according to the invention in which vane 1 has a movable flap 2 attached thereto via pivot axle 3. Pivot axle 3 extends substantially perpendicularly to the chord of the vane 1 such that flap 2 may pivot with respect to the remaining structure of the vane 1. Vane 1 may have an airfoil cross-section with a first, concave surface **1*a* and a second, convex surface 1*b* joined at a leading edge portion 1*c* and an intermediate portion 1*d*. The exterior surface 2*a* of flap 2 is continuous with the concave surface 1*a* such that, when the flap 2 is retracted, as shown in FIG. 1**, a substantially unbroken, concave surface is defined.

Figure 2:
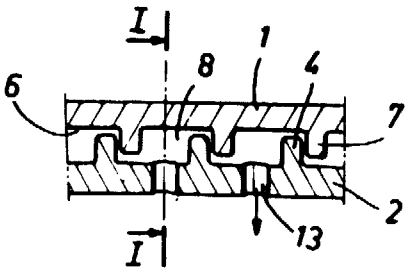
FIG. 2 is a partial, cross-sectional view taken along line II—II in FIG. 1.
Figure 5:
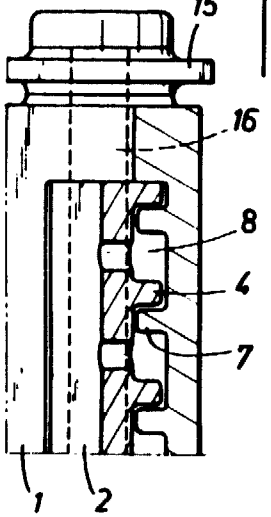
FIG. 5 is a partial, cross-sectional view taken along line V—V in FIG. 4.

The stator vane 1 may define a first cooling chamber 9 which may be supplied with cooling air via means which are well known in the art. Typically, relatively cool air is taken from a compressor stage and is directed toward the interior of the stator vanes. A second cooling chamber 8 is also defined between an interior surface 6 of trailing edge portion 5 and an interior surface of flap 2. Cooling ribs 4 extend into the cooling cavity 8 from the interior surface of the movable flap 2 and serve not only to improve the cooling of this flap, but to increase its mechanical strength. Cooling fins 7 also extend into cavity 8 from surface 6 of trailing edge portion 5 so as to improve the cooling of this portion of the stator vane. The widths of the cooling ribs 4 and 7 are such that, when the flap 2 is in its retracted or nominal position, the cooling ribs overlap as shown in FIGS. 2 and 5. Upstream portions of the ribs 4 and 7 may have enlarged portions to engage the pivot axle 3 in the form of a "piano" type hinge. Flap 2 may also extend along substantially the entire length of the vane 1, and the coolig ribs 4 and 7 may extend generally parallel to the chord of the vane.

The intermediate portion **1*d* of the stator vane may also define cooling passages 10 and 11 therethrough so as to facilitate communication of the cooling air from cooling chamber 9 to cooling chamber 8. The cooling air passing through passage 10 will serve to cool the hinge and pivot axle 3 before passing into chamber 8. Passage 11 allows cooling air to pass over the opposite side of the hinge and pivot axle 3 before escaping from the vane in the direction of arrow F shown in FIG. 1**.

A slot 12 is defined between the extremeties of flap 2 and a trailing edge portion 5 when the flap 2 is in its retracted or nominal position so as to allow cooling air to escape from chamber 8. Additional cooling air escape holes 13 are provided in flap 2 as shown in FIGS. 1, 2, 3 and 4.

Figure 4:
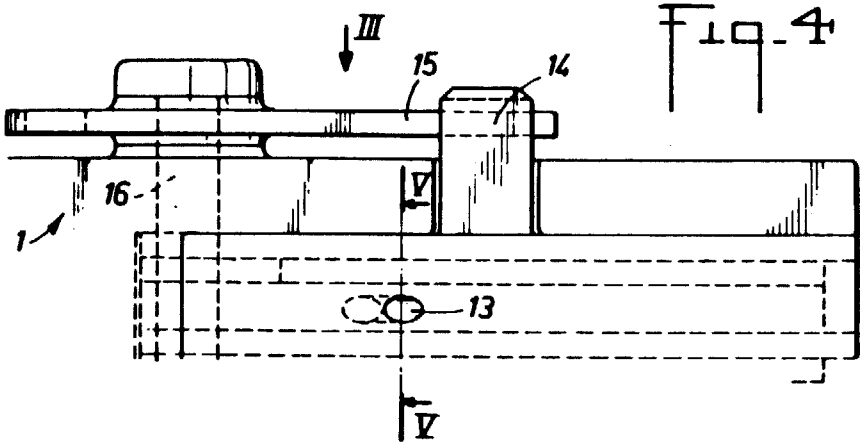
FIG. 4 is a partial view, taken in the direction of arrow IV in FIG. 3.
Figure 3:
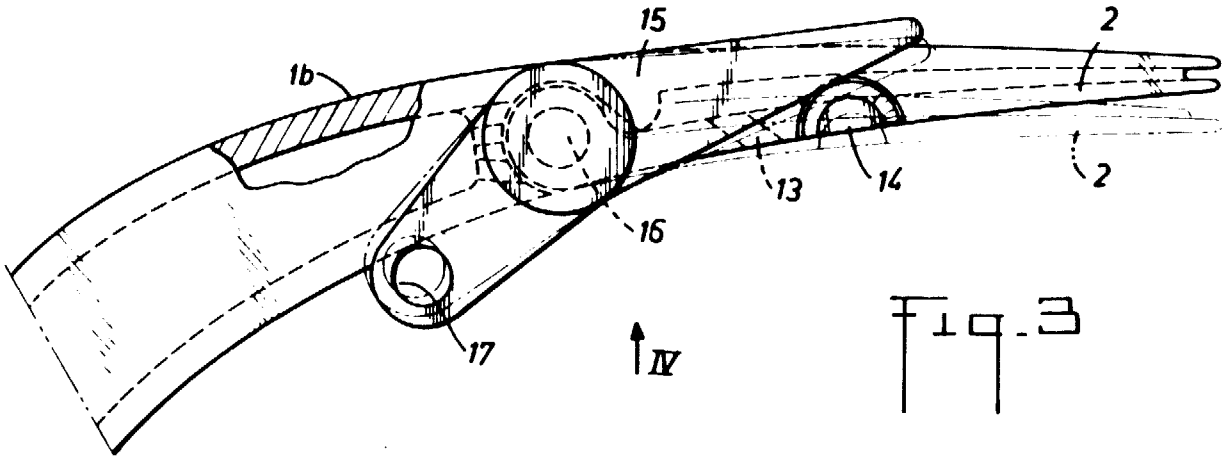
FIG. 3 is a partial view taken in the direction of arrow III in FIG. 4, partially broken away, showing the stator vane according to the invention.

In order to move the flap relative to the stator vane, the mechanism shown in FIGS. 3, 4 and 5 may be utilized. The mechanism comprises a lever 15 attached to the stator vane 1 so as to pivot about axle 16. Axle 16 may be coincedent with pivot axle 3 of the movable flap 2. A first end of lever 15 bears, against a cam member 14 rigidly attached to flap 2. At it second, opposite end lever 15 defines hole 17 which receive any known actuating mechanisms to cause lever 15 to pivot about axle 16. As best seen in FIG. 3, as the lever 15 pivots in a clockwise direction, the flap 2 is moved from its retracted or nominal position, shown in solid lines in FIG. 3, to an extended position, shown in dashed lines in FIG. 3. Movement of the flap 2 in this direction serves to restrict the gas flow between the stator vane to which the flap is attached and a stator vane adjacent to the concave surface of this vane. It is possible to affix each of the levers 15 in an array of stator vanes to a common, rotatable ring such that each of the movable flaps may be simultaneously actuated. The movement of the control ring may be controlled by known hydraulic or pneumatic cylinders.

The foregoing description is provided for illustrative purposes only and should not be construed as in any way limiting this invention, the scope of which is defined solely by the appended claims.

What is claimed is:

1. a turbine stator vane comprising:

(a) a first wall defining a first, concave surface the first wall having a chord dimension d;

(b) a second wall attached to the first wall to form a leading edge portion of the stator vane, the second wall defining a second, convex surface; an intermediate portion so as to define a first cooling chamber with the first wall and further defining a first trailing edge portion, the second wall having a chord dimension d' such that $d' > d$;

(c) a movable flap having an upstream portion, a second trailing edge portion and a third, concave surface;

(d) attaching means to pivotally attach the upstream portion of the flap to the intermediate portion of the second wall such that the first and third concave surfaces are substantially continuous, that the flap is movable about an axis extending generally perpendicular to a chord of the stator vane and such that a second cooling chamber is defined by the intermediate portion, and the first and second trailing edge portions; and, (e) means to move the flap about the axis.

2. The stator vane according to claim 1 further comprising:

(a) at least a first cooling rib extending from the first trailing edge portion into the second cooling chamber; and, (b) at least a second cooling rib extending from the second trailing edge portion into the second cooling chamber.

3. The stator vane according to claim 2 wherein the first and second cooling ribs extend generally parallel to the chord of the stator vane.

4. The stator vane according to claim 3 wherein the widths of the first and second cooling ribs are such that they overlap each other at least at one extreme position of the movable flap.

5. The stator vane according to claim 1 further comprising at least one cooling passage defined by the intermediate portion so as to interconnect the first and second cooling chambers.

6. The stator vane according to claim 1 wherein the first and second trailing edge portions define a slot therebetween so as to allow cooling air to exit from the second cooling chamber.

7. The stator vane according to claim 6 further comprising at least one exit hole defined by the movable flap so as to allow cooling air to exit from the second cooling chamber.

8. The stator vane according to claim 1 wherein the means to move the flap comprises:

(a) a lever pivotally attached to the stator vane, the lever having a first end; and, (b) a cam member attached to the flap and bearing against the first end of the lever such that as the lever is pivoted, the flap is caused to move about its axis.

* * * * *

UNITED STATES PATENT AND TRADEMARK OFFICE

CERTIFICATE OF CORRECTION

PATENT NO. : 4,705,452

DATED : November 10, 1987

INVENTOR(S) : Georges KARADIMAS

It is certified that error appears in the above—identified patent and that said Letters Patent is hereby corrected as shown below:

Col. 1, line 11, should read, "have an airfoil cross-section";

Col. 1, line 20, "throat neck" should be --throat--;

Col. 1, line 29, "referred" should be --required--;

Col. 1, line 44, the comma after "attached" should be deleted;

Col. 3, line 7, "At it" should be --At its--;

Col. 3, line 8, "which receive", should be --which may receive--.

Signed and Sealed this

Twenty-eighth Day of June, 1988

*Attest:*

*Attesting Officer*

DONALD J. QUIGG

*Commissioner of Patents and Trademarks*